United States Patent [19]

Kuehlhorn

[11] 4,254,903

[45] Mar. 10, 1981

[54] CARTON STRUCTURE

[76] Inventor: Bert O. Kuehlhorn, Rte. 1, Box 134B, Lancaster, Va. 22503

[21] Appl. No.: 83,244

[22] Filed: Oct. 10, 1979

[51] Int. Cl.[3] ..... B65D 5/22; B65D 5/64

[52] U.S. Cl. ..... 229/45 R; 229/35

[58] Field of Search ..... 229/43, 45, 35

[56] References Cited

U.S. PATENT DOCUMENTS

| | | | |
|---|---|---|---|
| 1,700,402 | 1/1929 | Ethridge | 229/45 |
| 1,731,007 | 10/1929 | Graffenberger | 229/35 |
| 2,220,388 | 11/1940 | Beaman et al. | 229/45 X |
| 2,625,315 | 1/1953 | Fehrenkamp | 229/45 |
| 2,768,778 | 10/1956 | Ferguson et al. | 229/45 |
| 3,258,188 | 6/1966 | Houston | 229/45 X |
| 3,342,401 | 9/1967 | Kitchell | 229/35 |
| 3,511,430 | 5/1970 | Chuber et al. | 229/35 |
| 3,526,249 | 10/1970 | Houston | 229/45 X |
| 4,065,048 | 12/1977 | Pilz | 229/43 |
| 4,134,532 | 1/1979 | Knight, Jr. | 229/35 X |

*Primary Examiner*—Davis T. Moorhead

*Attorney, Agent, or Firm*—Hill, Van Santen, Steadman, Chiara & Simpson

[57] ABSTRACT

A covered box structure formed of sheet stock, comprising a box member and a cover member, the box member comprising a plurality of side walls and a bottom wall, the upper edges of the side walls having integrally connected cuff portions extending downwardly from the free edges of the side walls along the exterior faces of the side walls, each cuff portion being integrally connected with at least the cuff portion of one adjacent side wall, the cover member comprising a top wall and downwardly extending side walls, at least two side walls of said cover member having downwardly depending flaps which are inwardly and upwardly foldable, whereby they may be disposed between the corresponding side wall and associated cuff portion of the box member for interlocking the cover member to the box member, and forming hand-gripping portions thereat. The box and cover members both may be of foldable design adapted to be erected at time of use, with said cuff portions each being integrally connected at their corner junctions, and at least two cuff members being divided into sections forming intermediate edges extending from the upper edge of the associated cuff portion, permitting intermediate cuff portions of a plurality of walls to be folded from portions in a common plane containing corresponding portions of the box side walls to folded positions at the exterior faces of the respective walls.

19 Claims, 12 Drawing Figures

FIG. 1
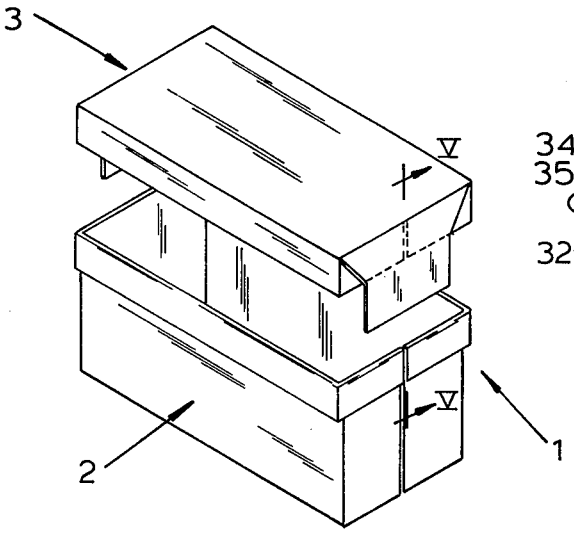
FIG. 3
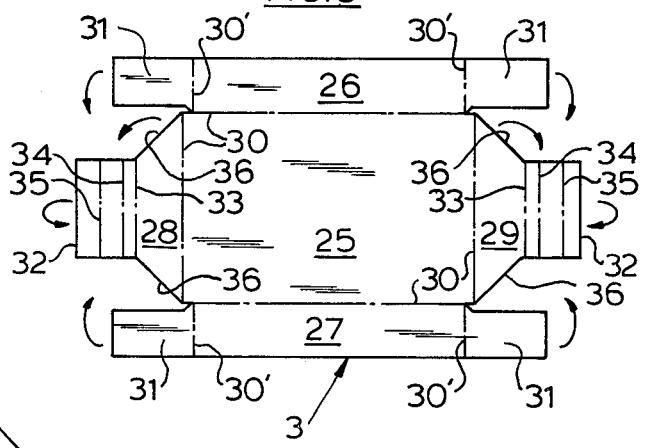
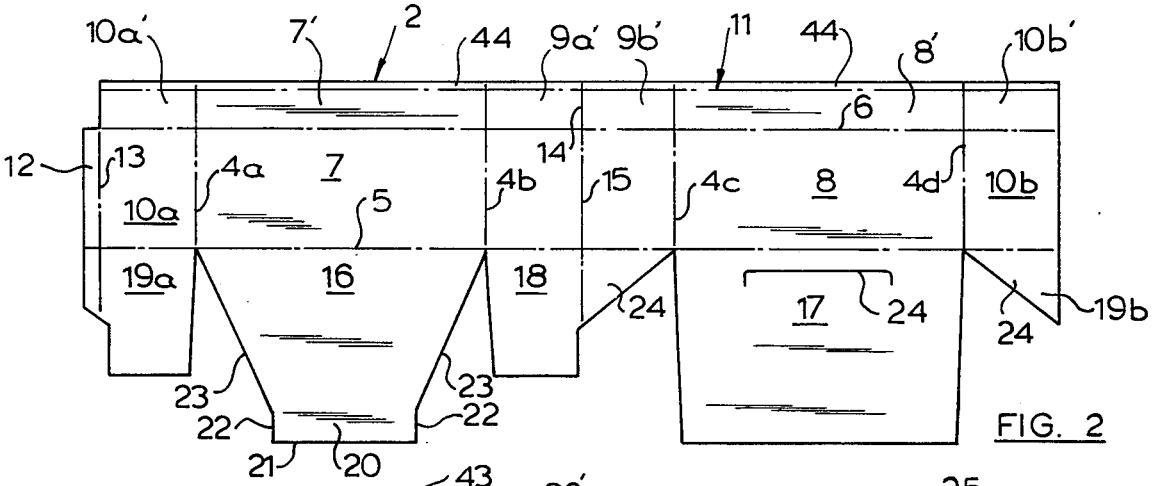
FIG. 2
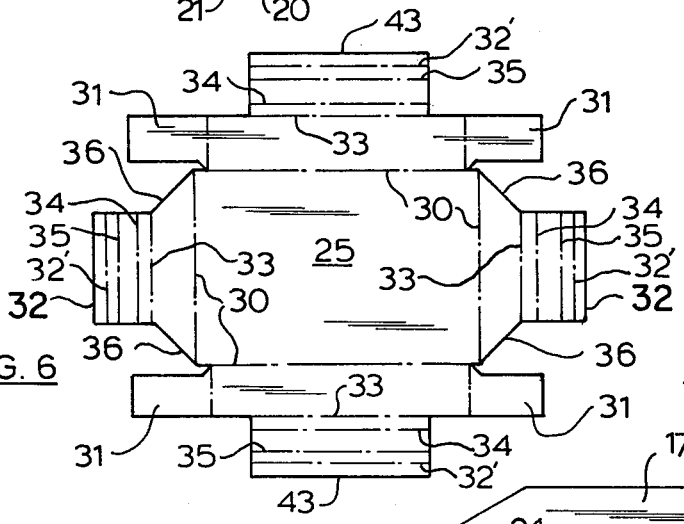
FIG. 6
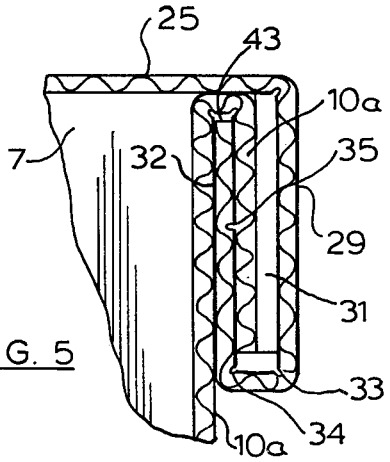
FIG. 5
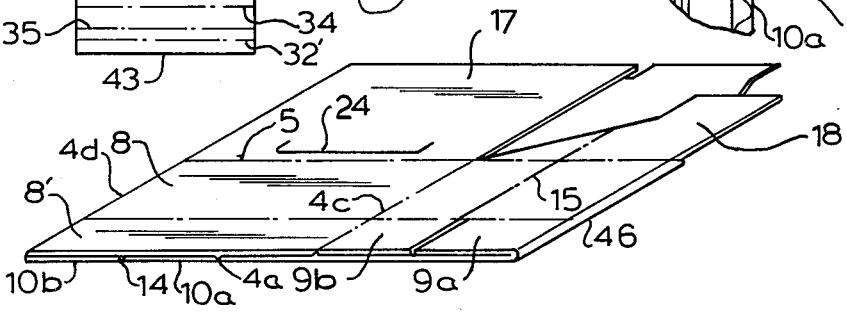
FIG. 4

FIG. 7
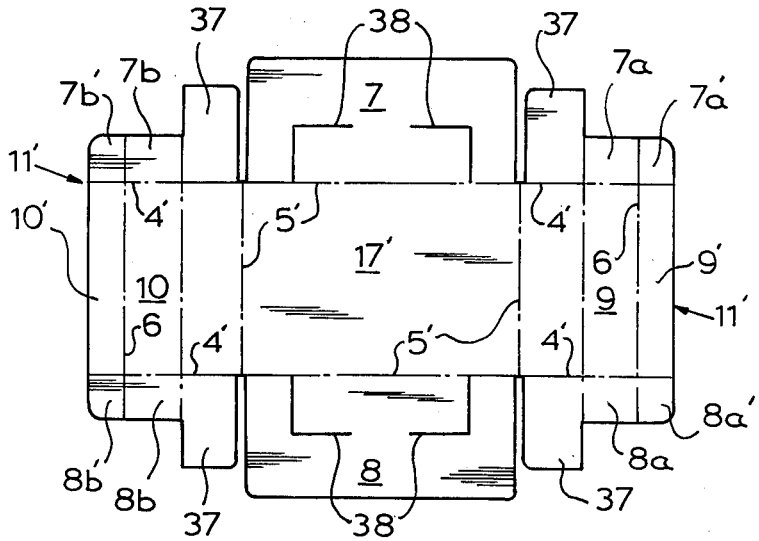
FIG. 8
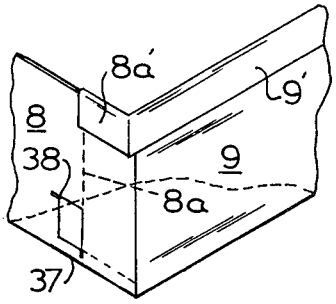
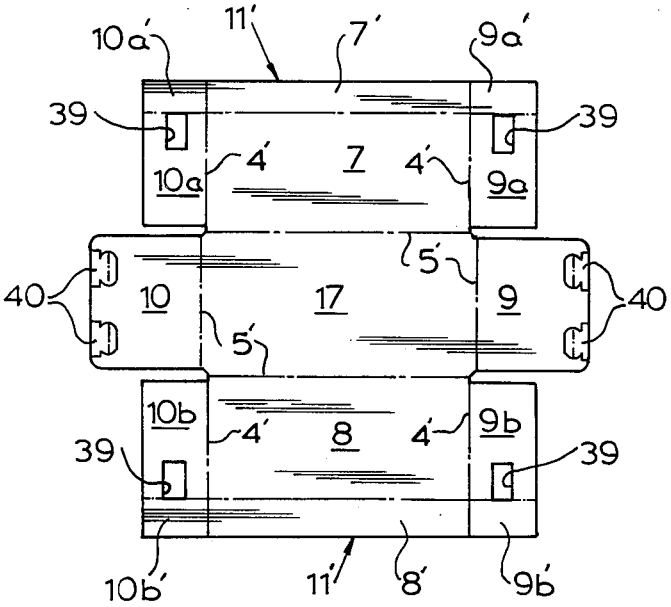
FIG. 9
FIG. 11
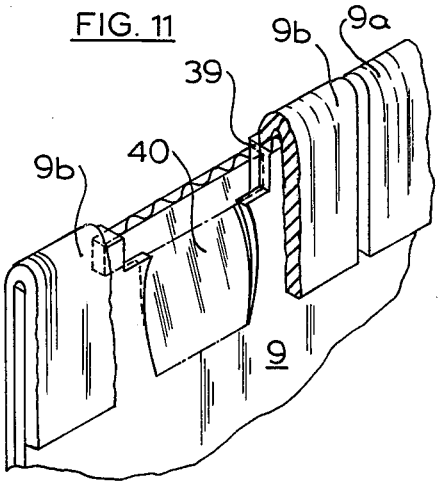
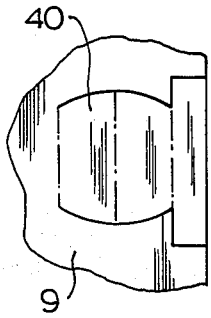
FIG. 10
FIG. 12
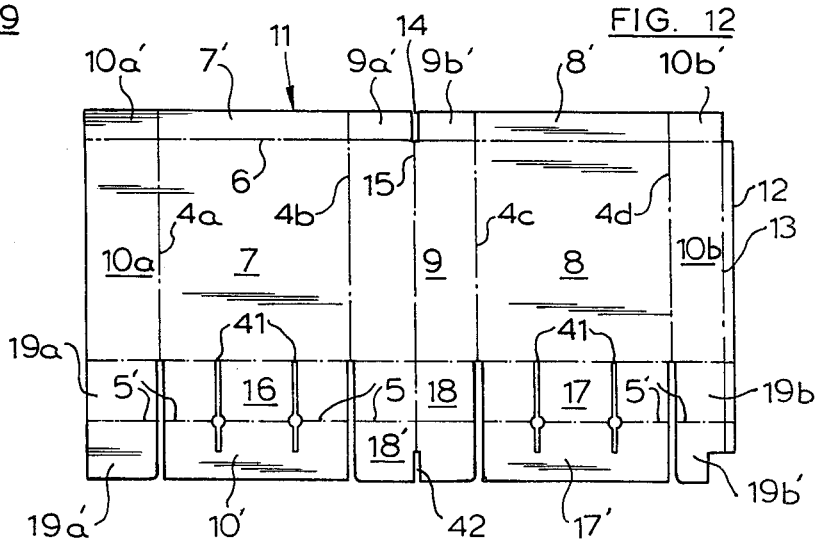

CARTON STRUCTURE

BACKGROUND OF THE INVENTION

The invention is directed to carton structures of the type which may comprise a box member and cover means therefor, which may be manufactured in knocked-down form having a flat knocked-down configuration and adapted to be erected into box structure at time of use by simple assembly operations, and which preferably provides convenient hand-gripping means for lifting the structure.

Various cartons of this type have been produced, particularly for file and transfer cartons, shipping cartons, as well as packing cartons employed in moving operations. Cartons of this general type are in most instances manufactured from corrugated stock, although fiber board cardboards have been extensively employed where practicable in dependence upon size, capacity, nature of contents, etc. More recently, various types of plastic and plastic or wax impregnated sheet stock, suitable for carton manufacture, have been put on the market.

Such cartons may utilize separate cover members or cover flaps and the like, and in many instances, hand-gripping arrangements have been provided, by means of which the carton may be manually picked up and carried. Such hand-gripping means in cartons of this type have taken the form of hand-receiving openings or holes in opposite carton side walls, a short distance below the top edge of the box, usually an elongated opening. Oftentimes such hand hole is formed of a generaly U-shaped cut to form a flap, integrally connected at its upper edge with the side wall, which is folded inwardly into the carton to reinforce the upper edge of the opening. In other cases merely a portion of the side wall is cut out to form the hand hole. In either case, particularly where the carton is heavily loaded, the side walls tear and deform when the carton is picked up. Likewise, the use of hand holes localizes the points at which the carton may be picked up and carried.

In addition, the carton cannot be packed wall-to-wall at such openings as this would prevent insertion of the fingers into the opening, and thus defeat the purpose thereof.

Further, where cartons of this type utilize a separate cover member, to insure retention thereof on the box member, additional means is required, for example, staples, glue, twine or strapping. Likewise, where cover members of this type are employed on box members provided with hand holes, the cover member provides no reinforcement or support with respect to such hand holes.

SUMMARY OF THE INVENTION

As mentioned, boxes of the general type described have wide application as packing boxes utilized in moving operations, as file storage boxes, transfer boxes and the like. In addition, a suitably designed box of this type, constructed from suitable material, could, in many cases, provide a substitute for wooden or other containers, in many diverse commercial fields, for example, various types of food processing applications, florist and nursery applications.

In order to meet necessary and desirable qualifications for these diverse applications, a box structure should be capable of fabrication with the following features.

It should have high efficiency with respect to strength and load capacity, in dependence upon the specific materials from which it is fabricated, and should be capable of manufacture from diverse materials, i.e., various types of corrugated and fiber board materials, various types of newer plastic and plasticized sheet material, etc. of waterproof construction, which are capable of being scored and folded to form box structures.

Both the box and cover member should be capable of manufacture in a flat, knocked-down condition occupying a minimum of space, in which condition they may be shipped, stored, etc., and erected into a box configuration at the desired location and time of use.

The box structure should be capable of provision of suitable hand grips that are exceedingly strong in view of the sheet material from which they are formed, and which does not involve weakening cutouts in the side walls of the box structure or entail a reduction in the cubic capacity of the box. Preferably, the cover member of the box structure should perform not only its customary covering function, but contribute to the overall box strength.

In addition, the box structure should be such that the cover member may be readily interlocked with the box member without additional securing means.

Not only should the box structure include these desirable features, but it should be capable of being readily produced on commercial box machines without requiring additional operations or equipment.

All of these advantages are embodied in a box structure constructed in accordance with the present invention. The box not only may be made from waterproof and other varying materials, and capable of being erected at time of use from a knocked-down condition, but provides a structure in which the box covered not only strengthens the box structure as a whole, but also provides a reinforcement of a hand-gripping structure which does not involve cutouts in the side walls of the box member, and in which lifting forces are distributed substantially throughout the side or end walls of the box structure at which the hand-gripping means is provided, thereby substantially eliminating any tendency for the adjacent side walls of the box structure to rupture or tear upon the application of lifting forces thereto. Further, the construction is such that a reinforced structure results on all sides of the box member by means of which the box may be grasped and lifted, and which may be further reinforced on all sides by the cover member.

In addition, a box member designed in accordance with the invention is readily capable of utilizing various, widely different bottom wall structures with either a solid box bottom or with a box bottom composed of bottom sections or portions carried by the respective side walls and suitably fastened or inerlocked with one another.

More particularly, the invention provides a box structure having side walls or side wall portions which are integrally connected at the box corners, in combination with outwardly and downwardly folded cuff portions, at the top edges of the box member, which extend partially or completely around the upper edge of the box member with the portions of the cuff members at the corners of the box member being integrally connected.

In a preferred construction, three of the four side walls of the box member are integrally connected at their corner junctures and the fourth side wall is formed in two sections disposed at opposite ends of the integrally connected side walls, with the two sections of the fourth wall being suitably secured together along their intermediate meeting edges to form a unitary fourth wall. In this construction, the bottom wall of the box would be formed by respective bottom sections, each carried by a respective side wall and formed integrally therewith with the various sections of the bottom wall being suitably secured to one another at the time of erection of the box structure, thus producing a fabricated bottom of several thicknesses. The actual configuration and interlocking relationship of the various bottom sections will be dependent upon the particular design employed. Likewise, the bottom could employ merely respective flaps, suitably folded inwardly and secured together by glue, staples, tape, etc. Any one of numerous commercial erectable bottom structures, currently in commercial production, may be employed and the details thereof, per se, form no part of the present invention.

In this construction, the upper edges of the side walls may be provided with continuously extending cuff members which are cut from the box stock and integrally connected along the upper free edges of the side walls of the box member. As in common practice, when forming the blank from which the box is to be fabricated, in addition to cutting a blank or desired configuration from the sheet stock, score lines are also formed along the various lines of juncture of the side walls, bottom portions, cuff portions, etc., and if so formed, the fourth side wall, i.e., composed of two side wall sections, is suitably secured together along the meeting edges of the sections, producing adjoining edges of the adjacent cuff portions associated with such side wall. The opposite side wall is, in such case, provided with a score line oppositely disposed to the line of securement of the sections of the fourth side wall and the cuff portion of such opposite side wall is provided with a knife-cut or slot therein defining intermediate end edges which are oppositely disposed to the corresponding intermediate edges of the fourth wall, thereby such two opposing walls may be folded back upon themselves, thus permitting the carton blank to be folded into a flat condition and at the same time, dispose the cuff portions between opposite intermediate edges to be readily folded back upon the associated side walls, after which the structure may be folded along the adjacent corners to dispose the side walls at right angles to one another in rectangular box configuration, with the cuff members extending around the upper edge of the side walls at the exterior faces thereof and integrally connected at the box corners, whereby any slits or slots in the cuff portions are disposed in intermediate portions thereof and not at the box corners. Following these operations, the sections of the bottom wall of the box may be readily folded into position and suitably secured or interlocked, in dependence upon the particular construction involved.

The cooperable cover member likewise is formed from flat sheet stock and comprises a top wall and side walls which are integrally connected to the top wall at their junctures, with a pair of oppositely disposed side walls being provided with additional laterally extending flap members or extension walls which are adapted to underline portions of the other pair of side walls when the cover member is in an erected condition. In addition, at least two side walls, preferably at least said other pair of side walls are provided with downwardly depending flap members. Preferably, the side walls carrying said depending flap members are the cover side walls corresponding to those of the box structure having the slit or slotted cuff portions, thereby, following positioning of the cover member on the box member, the flap portions may be folded inwardly and upwardly around the adjacent cuff portions of the box member. The box structure thus may be readily manually grasped, preferably by placing the hand opposite the folded flap members and hooking the fingers between the folded flap members and the adjacent side wall of the box, enabling lifting of the box structure from the cuff portions.

Lifting forces are thus distributed by the flap members to the adjacent cuff members, and through the latter to the entire upper edge of the side walls. Thus, not only do the flap members provide an interlock between the cover member and the box member, but they also contribute to a reinforcing of the hand-gripping portions of the box structure, resulting in a very strong and durable handgripping arrangement.

If desired, all four side walls of the cover member may be provided with similar flat members to provide an additional reinforcement between the cover member and the box member and in particular, to distribute stresses to all four side walls of the box member. To add further strength, the cuff members may be reinforced particularly along their edges by reinforced tape or the like, for example, such as used on cartons for tear strips, etc. Similar reinforcement could also be provided at other locations as desired.

As previously mentioned, the bottom of the box member may be of any suitable construction and the present invention readily adapted itself, if desired, to a self-partitioning carton in which individual cells are formed by structural elements carried by the various sections of the bottom wall.

BRIEF DESCRIPTION OF THE DRAWINGS

In the drawings wherein like reference characters indicate like or corresponding parts:

FIG. 1 is a perspective view of a box structure with the cover member thereof illustrated prior to its engagement with the box member;

FIG. 2 is a development of the blank for the box member illustrated in FIG. 1, following its fabrication from sheet stock and prior to its erection into a usable box member;

FIG. 3 is a similar development of the blank for the cover member illustrated in FIG. 1, following its fabrication from sheet stock;

FIG. 4 illustrates the box member following its fabrication and illustrates the manner in which it may be folded prior to its erection as a box member and in which folded condition it may be transported, stored, etc.;

FIG. 5 is a sectional view taken approximately on the line V—V of FIG. 1 with the cover member interlocked to the box member;

FIG. 6 is a plan or development similar to FIG. 2, of a cover member having reinforcing flaps on all four side walls;

FIG. 7 is a development of a box blank illustrating the application of the present invention to a box structure utilizing a solid bottom wall to which all side walls are integrally connected;

FIG. 8 is a perspective view of a corner portion of the box member illustrated in FIG. 7, following erection thereof;

FIG. 9 is a development of a box blank similar to FIGS. 3 and 7 illustrating still another form of box structure utilizing a solid bottom member;

FIG. 10 is an enlarged fragmentary portion of a portion of the box blank illustrated in FIG. 9, illustrating details of an interlocking tab structure employed therewith;

FIG. 11 is a perspective view of a portion of an end wall of an erected box member embodying the construction illustrated in FIGS. 9 and 10; and FIG. 12 is a development of a box structure in accordance with the present invention, embodying a bottom wall structure which includes cell partitions.

DETAILED DESCRIPTION OF THE INVENTION

Referring to FIGS. 1–3, the reference numeral 1 designates generally a box structure comprising a box member, indicated generally by the reference numeral 2, and a cover member, indicated generally by the reference numeral 3. Both are adapted to be formed from sheet stock on ordinary carton-forming equipment. As illustrated in FIG. 2, the box member 2 is formed from a single piece of sheet stock and is provided with score lines 4*a*, 4*b*, 4*c* and 4*d* which define the four corners of the box. A continuous score line 5 defines the bottom corners of the box and an upper continuous score line 6 defines the upper edge of the respective side walls of the box, illustrated as being of generally rectangular construction having two long side walls 7 and 8 and two relatively short end walls 9 and 10, the latter comprising two sections 10*a* and 10*b* defining opposite ends of the blank illustrated in FIG. 2. The portion of the blank above the score line 6 is adapted to form a cuff member, indicated generally by the reference numeral 11, which extends outwardly from the top edges of the respective side walls, defined by the score line 6. The score lines 4 thus divide the cuff member 11 into portions corresponding to the respective side walls, i.e., cuff portions 7′, 8′, 9′, 10*a*′ and 10*b*′. In The construction illustrated, the side wall portions 10*a* and 10*b* are of equal width, i.e., their juncture lines on the wall center line, and the section 10*a* is provided with a glue flap 12, by means of which the sections 10*a* and 10*b* may be secured together, for example, by gluing. The juncture of the flap 12 and side wall sections 10*a* may be defined by a score line 13. It will be apparent that by reason of the sectional construction of the side wall 10, the associated cuff member likewise is in the form of two sections 10*a*′ and 10*b*′. The cuff member associated with the side wall 9 is similarly divided into two sections 9*a*′ and 9*b*′ by a knife cut 14, which division may take the form of a slit or a wider slot, and likewise divides the cuff into two equal portions. The side wall 9 is also provided with a vertical score line 15 which is aligned with the cut 14 and thus corresponds to the score line 13 forming the junction line between the side wall sections 10*a* and 10*b*. Thus, in the configuration described, the score lines 13 and 15 are spaced a distance equal to one-half the circumference of the box thereby each side wall 7 and 8 associated section of the end walls 9 and 10 are of equal combined lengths and thus the total length of the portions of the cuff member 11 at each side of the slit 14 are equal.

Each side wall 7 and 8 is provided with a respective bottom wall portion 16 and 17 and end wall portions 18 and 19*a*, and 19*b*, the latter corresponding to the associated end wall sections 10*a*, and 10*b*, with the flap 12 extending along the juncture of the portions 19*a*–19*b*. The bottom wall portion 16 is provided with a generally rectangularly-shaped flap 20 at its outer edge formed by a horizontal edge 21 and vertically extending side edges 22 with diagonally extending edges 23 extending from the inner ends of the edges 22 to the juncture of the score lines 4*a* and 4*b* respectively with the score line 5. Likewise, the portion 19*b* and corresponding portion of the wall 18 are provided with diagonally extending edges 24. The bottom wall section 17, carried by the side wall 8, is rectangular in configuration and has a length and width approximately equal to the corresponding dimensions of the sides and end walls, thus extending completely across the bottom of the box member. The portion 17 is also provided with a U-shaped knife cut 24 which extends through the portion 17 and is of a size to receive the tab 20 on the bottom portion 16. Thus, when the side walls are disposed in box-forming position, the bottom portions 18 and 19*a*–19*b*, may be folded inwardly approximately into the plane of the score line 5, after which the portion 17 may be folded into like position, followed by the portion 16 with the tab 20 being inserted in the cut 24 to interlock the two portions 16, 17 and thus form the bottom of the box member.

For packaging, during shipment and storage, the box member, following connection of the side wall sections 10*a*, 10*b* and bottom portions 19*a* and 19*b*, may be folded flat along diagonally opposite corner score lines 4 to form a flat structure such as illustrated in FIG. 4. However, when it is desired to fold the box blank into an erected box member, the structure is unfolded at the particular corner score lines and refolded into a similar position on the score lines 13 and 15, thus bringing the integral cuff section 10*a*′, 7′, 9*a*′ into a common plane and likewise the integral cuff section 10*b*40 , 8′, 9*b*′ into a common plane. With the structure so disposed, the respective integral cuff sections may now be folded outwardly back upon the corresponding portions of the associated side walls, and with the cuff portions so positioned, the structure may now be folded on the score line 4 to bring the side walls and the cuff members into the positions illustrated in FIG. 1. Assembly of the box member is completed by folding the bottom wall portions, as previously described, to complete the bottom wall assembly. It will be particularly noted that in the box member so formed the cuff members of the respective side walls are integrally connected with one another, at the box corners, with any intermediate cuff edges at the cut 14 or at the score line 13 falling in an intermediate part of the associated cuff member, so that all cuff members are integrally connected to the box corners.

As illustrated in FIG. 3, the cover member 3 is likewise formed in the single piece of flat stock which is cut to form a central cover wall 25 which is provided with side walls 26 and 27, and end walls 28 and 29 with the blank having score lines 30 at the junctures of the top wall 25 with the respective side walls, along which the side walls may be folded to positions at right angles with respect to the plane of the top wall 25 to form a tray-like cover member. As illustrated in FIG. 3, the long side walls 26 and 27 are rectangular in shape and provided at their ends with respective laterally extending side flaps 31 which are adapted to be bent along the score lines 30' at right angles to the side walls 26 and 27, respectively and disposed to underlie the side walls 28 and 29, following folding of the latter into erected positions.

The shorter cover side walls, i.e., end walls 28 and 29 are provided with depending flaps 32 which are rectangular in shape. Each flap 32 is connected to the associated end wall by a score line 33 and in addition each tab is provided with further score lines 34 and 35.

As illustrated in FIG. 3, the end walls 28 and 29 have diagonally disposed bottom edges 36 which extend from the inner end of the side edges of the tab 32 to the corners of the top portion 25.

In use, the cover member 3 is folded to dispose the respective side walls in operative position, with the portions 31 underlying the respective end walls 28, 29 as illustrated in FIG. 1, and the cover mounted on the top of the box member 2. The side walls of the cover member are so proportioned with respect to their vertical height as viewed in FIG. 1 that they are substantially equal to the corresponding dimension of the cuff member 11, so that upon positioning of the cover, as illustrated in FIG. 3, the flaps 32 may be folded around the free bottom edge of the adjacent cuff member and slid upwardly into the adjacent space between the cuff member and associated side wall. As illustrated in FIG. 5, the score line 33 permits the adjacent portion of the flap 32 to be readily folded around the bottom edge of the cuff member while the score line 34 permits the flap to be readily folded upwardly between the cuff member and the side wall portion. The additional score member 35 provides a degree of flexibility in the flap member to facilitate its folding around the lower edge of the cuff member without buckling or crinkling of the flap.

It will be appreciated that the interlocking construction of the cover member with the box member results in a very effective securement of the cover member to the box member, that will effectively prevent accidental disconnection of the cover member from the box member. At the same time, the flap portions provide a convenient reinforced hand grip, by means of which the carton may be lifted and supported. It will be apparent that this construction has a number of advantages. First, the cover is not only interlocked with the box member under normal conditions, but upon grasping the carton to lift the same, the lifting force is applied both to the cover member and the box member, with stresses being transmitted from the flap 32 through the cuff member and thereby distributed substantially all along the upper edge of the adjacent end of the side wall. Further, the flaps 32 span the only breaks or cuts in the cuff member and so reinforces the latter at their only points of minimum strength. In addition, lifting forces being transmitted through the cover member, eliminate any tendency of the cover member to detach itself from the box member during such operation. The flaps 32 also are particularly advantageous with respect to the cover member itself as the flaps, when folded into position illustrated in FIG. 5 also lock the cover flaps 31 into operative position and thus resist movement of the flaps and therefore resist outward pivotal movement of the side walls 26 and 27 of the cover member, thereby retaining the cover member in assembled relation.

As illustrated in FIG. 6, it may be desirable, in some applications, to provide similar edge flap members 43 on the side walls 26 and 27 of the cover member, whereby the side edge flaps 43 may be folded upwardly between the cuff members 7' and 8'. The flaps 43 may also be provided with score lines 34 and 35 as well as score line 33. The flaps 32 and 43 may further be provided with an additional score line 32' for an extra fold line.

It will be appreciated that, as previously mentioned, the details of the bottom wall of the box member 2, per se, form no part of the invention and any suitable bottom structure, of which there are numerous different configurations on the market, may be employed therefor.

The invention is also applicable to box structures having a solid bottom wall from which the respective integrally connected side walls depend, the application of the present invention to such type of bottom walls is illustrated in two examples, the first being illustrated in FIGS. 7 and 8, and the second in FIGS. 9–11.

Referring to FIGS. 7 and 8, the blank illustrated in FIG. 7 comprises a bottom wall 17' to which are integrally connected side walls 7 and 8 and end walls 9 and 10. Each of the end walls 9 and 10 are provided with integrally connected side wall sections, the end wall 9 carrying side wall sections **7*a* and 8*a*, and in like manner, the end wall 10 carrying side wall sections 7*b* and 8*b*, which are connected to their respective side walls at the box corners by respective score lines 4'**.

In this construction, the cuff sections 11' comprise end portions 9' and 10' and side wall portions **7*a'*, 7*b'*, 8*a'* and 8*b'***.

Each of the side wall sections **7*a*, 7*b*, 8*a*, 8*b* are provided with longitudinally extending tongue members 37 which are adapted to be inserted in suitably dimensioned L-shaped knife-cuts 38 when the box member is in erected condition. The blank illustrated in FIG. 7 may be folded to provide a box member, such as partially illustrated in FIG. 8, by initially folding the respective flap sections 11' along the fold lines 6 to dispose the cuff portions in overlying relation to the outer faces of the respective end walls and side wall portions, after which the side wall portions 7*a*, 7*b*, 8*a*, 8*b* may be folded inwardly along the score lines 4'**, to positions at substantially right angles to their associated end walls.

The side walls 7 and 8 may then be similarly folded to upright position, followed by a similar folding of the end walls 9 and 10, keeping the side wall portions **7*a*, 7*b*, 8*a*, 8*b* adjacent the inner faces of the side walls 7 and 8 and inserting the tongue 37 upwardly through the slots 38 as the end walls are rotated in position. At the same time, the cuff portions 7*a'*, 7*b'*, 8*a'* and 8*b'* are disposed adjacent the exterior faces of the respective walls 7 and 8, as illustrated in FIG. 8. An interlocking assembly is produced in which a rigid box member results having cuff members extending along each side wall, with each cuff portion of one side wall being integrally connected with a cuff portion of the adjacent side wall. Such box member would employ a suitably dimensioned cover member constructed in the same manner as illustrated in FIGS. 1, 2 and 6, and the flap members 32 of the cover member could then be folded up under the associated cuff member 9' or 10'**.

The construction illustrated in FIGS. 9–11, likewise employs a solid integral bottom wall 17' which carries side walls 7, 8, 9 and 10 connected to the bottom wall along corresponding score lines 5'. The side wall 7 is provided with two end wall portions **9*a* and 10*a* while the side wall 8 is provided with similar flaps 9*b* and 10*b*** which are connected to their respective side walls by corner score lines 4'. Disposed at the outer edges of the side walls 7 and 8 and side wall portions 9a, 10a, 10b are respective cuff members 11', one of which comprises the cuff members 7' associated with the side wall 7 and the cuff portions 9a', 10a' associated with the side wall portions 9a, 10a and in like manner, the other cuff section 11' comprises the cuff portion 8' associated with the side wall 8 and the portions 9b' and 10b' associated with the corresponding side wall portions 9b and 10b.

The side wall portions 9 and 10 are provided with respective tabs 40 which are cut from, but integrally connected with the associated side wall portions 9 and 10 and the side wall portions 9a, 10a, 9b, 10b are each provided with a generally rectangular slot 39 therein. In folding the blank illustrated in FIG. 9 to form a box construction, the cup sections 11' are folded along the score line 6 to position adjacent the exterior face of the associated side wall, following which the end wall portions 9a, 10a and 9b, 10b are folded inwardly along the corner score lines 4'. The side walls 7 and 8 are then folded upwardly into vertical positions, following which the end walls 9 and 10 are folded up into vertical position, bringing the outer edges of the end walls 9 and 10 beneath the associated cuff portions 9a', 9b' and 10a' and 10b' as illustrated in FIG. 11. The proportions of the slots 39 and tabs 40 and their positions in the associated members are such that the tab members 40 may then be pushed inwardly through the slots 39 to interlock the end wall portions 9a, 9b with the associated end wall 9 and in like manner, the end wall sections 10a and 10b with the associated end wall 10. Again, the resulting box member is extremely rigid and durable and may be used in conjunction with a suitably proportioned cover member constructed in accordance with FIGS. 1 and 3 or FIG. 6.

FIG. 12 illustrates the application of the invention to a self-partitioning carton which is provided with integrally connected partition members adapted to define cells for receiving bottles, etc. In this construction, the side and end wall structure as well as the cuff structure and flap 12 are identical to that illustrated in FIG. 1 with the exception of the proportions of the various components. Likewise, the bottom wall comprises bottom wall sections 16, 17, 18 and 19a–19b. However, each of the bottom wall sections includes partition members 16', 17', 18' and 19a'–19b' which are joined to their associated bottom wall sections at corresponding score lines 5. In addition, the bottom wall sections 16 and 17 and corresponding partition wall sections 16' and 17' have respective slots 41 therein with such slots extending across the bottom wall sections 16 and 17 and substantially half way through the partition sections 16' and 17'. In like manner, the partition section 18' is provided with a slot 42 therein and the section 19b' is provided with a notch 42' which is cooperable with the adjacent edge of the partition section 19a', when the sections are joined at the flap 12, to form a slot corresponding to the slot 42 in the section 18'.

The cuff member is divided into two sections by a slot 14' as in the construction of FIG. 2 and the cuff and side walls are erected in the same manner as previously described in connection with the structure of FIG. 2. However, when the side walls are in operative position, the partition portions 16' and 17' are folded about the fold lines 5' to positions at right angles to the respective bottom sections 16 and 17. The latter may then be folded on the score lines 5 to dispose the sections 16 and 17 in a common plane after which the partition sections 18' and 19a'–19b' are folded inwardly along the score lines 5' to positions at substantially right angles to the associated bottom wall sections 19a and 19b. The latter are then folded on the score lines 5 to bring such portions substantially into the plane of the bottom sections 16 and 17, simultaneously sliding the associated partition sections 18' and 19a'–19b' through the respective adjacent aligned slots 41. The partition section 18' and 19a'–19b' may be inserted completely through the bottom wall, with the slots 42 of such partition sections receiving the portions of partition sections 16' and 17' disposed in alignment with the slots 41 to form a carton having partition walls adjacent the bottom thereof defining, in this case, six compartments.

In some applications of the invention, it may be desirable, where corrugated stock is employed to run the corrugations in the side walls, and thus in the cuff members, horizontally. Likewise, when the corrugations in the side walls run vertically, and when otherwise deemed desirable, portions of the box member may be reinforced by suitable means, such as reinforcing strips of tape, or the like, for example, by the use of fiber reinforced tape such as currently employed in box manufacturing for tear strips and the like. This might be deemed desirable, in particular, along the outer edges of the cuff portions and of the cover flaps. FIG. 6 illustrates the use of such a string 43 on the flaps 32 and FIG. 2 illustrates the use of such a strip 44 on the cuff member 11.

This construction likewise could employ a suitably dimensioned cover member constructed in substantially the same manner as that illustrated in FIGS. 1 and 3 and capable of being interlocked with the cuff members of the box member as previously described for the other constructions.

It will be appreciated that the invention may be readily adapted to box designs utilizing bottom structures other than that herein illustrated, with the construction being such that, irregardless of construction, the box member will be provided with integrally connected cuff portions extending from each corner of the box member, and which may be utilized with a cover member constructed as described.

Those skilled in the art will readily appreciate the fact that the invention is such that it may be practised with the use of any of the usual types of box forming machines employed to produce box structures and cover structures of the same general type.

It will also be particularly noted that the structure readily adapts itself to the use of substantially any sheet stock suitable for box fabrication whether of cardboard, fiberboard, corrugated board, or various types of plastic and plasticized sheet material, etc.

It will further be noted that the construction is such that it readily adapts itself to food packaging and particularly sea food and other packaging requiring waterproof construction and which heretofore has normally employed wooden crates, etc.

The invention is particularly adaptable to uses where the cartons are to be subjected to a large amount of manual handling as for example, file and transfer cases, packing cases for moving operations, etc. It will be appreciated that the invention offers particular advantages in these categories as paper files and the like involved considerable weight for their bulk and it is a common experience to any one, who has utilized cases of this general type having hand cut-outs in the end walls, that it is readily possible to place a sufficient number of files in such a case that rupturing of the side walls at the handle openings becomes a routine experience.

It will also be apparent that the invention also has numerous other applications in various fields as for example in packaging relative large objects where a cover member or the like can be readily attached to the enclosing box structure without the necessity of staples, adhesive, banding, etc.

Although I have described my invention by reference to particular illustrative embodiments, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim as my invention:

1. A covered box structure formed of sheet stock, comprising a box member and a cover member, the box member comprising a plurality of side walls and a bottom wall, the upper edges of the side walls having cuff portions integrally connected with and extending downwardly from the free upper edges of the side walls along the exterior faces thereof, said cuff portions extending along adjacent intersecting side walls of the box member integrally connected through each corner thereof, the cuff portions of two oppositely disposed side walls being divided intermediate their ends into two sections by respective slots, the cover member comprising a top cover wall and downwardly extending side walls, two oppositely directed side walls of said cover member having downwardly extending flaps which are inwardly and upwardly foldable and are formed of widths for spanning said respective slots, whereby they may be disposed between corresponding side walls and associated divided cuff portions of the box member and across said slots respectively for interlocking the cover member to the box member.

2. A box structure according to claim 1, wherein both the box and cover members are of foldable design adapted to be erected from a flat folded box blank and a flat cover blank at the time of use.

3. A box structure according to claim 2, wherein said box member has four side walls and a bottom wall formed from bottom portions carried by the respective side walls, at least two of which bottom portions have interlocking elements for retaining said bottom wall in assembled relation.

4. A box structure according to claim 3, wherein said side walls are integrally connected with one another at their corner junctures and one of said side walls is formed in two sections, which are secured along their meeting edges, the juncture of said sections forming one pair of said intermediate edges of the adjacent cuff portions associated with the cooperable side wall, and the cuff portions associated with the opposite side wall being provided with the other oppositely disposed other pair of intermediate edges, whereby portions of said side walls of the box member at opposite sides of said intermediate edges may be folded back upon themselves forming a flat folded structure.

5. A box structure according to clain 1, wherein the bottom wall of said box member is of one-piece construction and said side walls are each integrally connected with said bottom wall at their junctures therewith, a pair of oppositely disposed side walls having laterally extending side wall sections integrally connected with the side edges of said side walls, said cuff portions being integrally connected to said side wall sections and the associated side walls, said side wall sections in the erected box member being folded inwardly at right angles to their associated side walls and disposed along the inner faces of the adjacent independent side walls with the cuff portions of the side wall sections being disposed at the outer faces of said adjacent side walls with the upper free edges of the latter disposed between the adjacent cuff portion and associated side wall section.

6. A box structure according to claim 5, wherein said side wall sections and said adjacent side walls have cooperable interlocking connecting elements.

7. A box structure according to claim 6, wherein said connecting elements comprise a tongue member on one and a cooperable slit on the other of each cooperable pair of said side wall sections and said adjacent side walls.

8. A box structure according to claim 7, wherein said tongue members are carried by respective side wall sections and said slits are of L-shaped configuration and are disposed in said adjacent side walls.

9. A box structure according to claim 6, wherein said connecting element comprise a slot on one, and a tab on the other of each cooperable pair of said side wall sections and adjacent side walls.

10. A box structure according to claim 9, wherein said tabs are of generally T-shaped configuration.

11. A box structure according to claim 3, wherein said bottom wall comprises bottom portions, each integrally connected with a respective side wall, said bottom portions each having a partition member carried thereby, certain of said bottom portions having slots therein whereby said partition members may extend through said bottom wall at said slots and cooperate to divide the box member, adjacent the bottom wall thereof, into partitioned cells.

12. A box structure according to claim 11, wherein said partition members are provided with notches therein for receiving portions of other partition members to form an interlocking connection therebetween.

13. A box structure formed of sheet stock, comprising four side walls and a bottom wall, the upper edges of the side walls having cuff portions integrally connected with and extending downwardly from the free upper edges of the side walls along the exterior faces thereof, cuff portions extending along adjacent intersecting side walls at each side corner of the box structure, being integrally connected at such corner, said box structure being of foldable design adapted to be erected from a flat folded box blank and a flat cover blank at the time of use, the cuff portions of two oppositely disposed side walls of the erected box member being divided intermediate their ends into two sections, forming intermediate cuff edges extending across the associated cuff member from the upper edge thereof to its lower edge, permitting cuff portions associated with a plurality of side walls at each side of said intermediate edges to be disposed substantially in a common plane, from which the associated cuff portions may be folded back along their junctures with the associated side walls to positions at the exterior faces thereof, after which the side walls may be folded at their corner junctures to form a box configuration with said cuff portions being disposed at the exterior faces of the corresponding side walls and integrally connected at their respective junctures, said bottom wall formed from bottom portions carried by the respective side walls, at least two of which bottom portions have interlocking elements for retaining said bottom wall in assembled relation wherein said bottom portions are integrally connected with a respective side wall, said bottom portions each having a partition member carried thereby, certain of said bottom portions having slots therein whereby said partition members may extend through said bottom wall at said slots and cooperate to divide the box member, adjacent the bottom wall thereof, into partitioned cells.

14. A box structure formed of sheet stock, comprising a plurality of side walls and a bottom wall, the upper edges of the side walls having cuff portions integrally connected with and extending downwardly from the free upper edges of the side walls along the exterior faces thereof, cuff portions extending along adjacent intersecting side walls at each side corner of the box structure, being integrally connected at such corner, the bottom wall being of one-piece construction and said side walls each integrally connected with said bottom wall at their junctures therewith, a pair of oppositely disposed side walls having laterally extending side wall sections integrally connected with the side edges of said side walls, each cuff portions being integrally connected to said side wall sections and the associated side walls, said side wall sections in the erected box member being folded inwardly at right angles to their associated side walls and disposed along the inner faces of the adjacent independent side walls with the cuff portions of the side wall sections being disposed at the outer faces of said adjacent side walls with the upper free edges of the latter disposed between the adjacent cuff portion and associated side wall section, said side wall sections and said adjacent side walls have cooperable interlocking connecting elements comprising a slot on one and a tab on the other of cooperable pairs of said interlocking connecting elements, wherein said tabs are of generally T-shaped configuration and said partition members are provided with notches therein for receiving portions of other partition members to form an interlocking connection therebetween.

15. A box structure according to claim 1, wherein the remaining side walls of said cover member have downwardly extending flaps which are inwardly and upwardly foldable, whereby they may be disposed between corresponding side walls and associated cuff portions of the box member.

16. A cover for closing a box having cuff portions integrally connected with and extending downwardly from the free upper edges of the side walls along the exterior faces thereof, said cuff portions being integrally connected through each corner of said box and the cuff portions of two oppositely directed side walls being intermediately divided into two sections by respective slots, said cover blank comprising:

a center piece having side edges, oppositely directed side portions intermediately integral with associated side edges of said center piece and downwardly foldable therefrom, side portion flaps at opposed ends of said side portions for extending freely outward therefrom and inwardly foldable from said side portions, oppositely directed end portions integral with associated side edges of said center piece and downwardly foldable therefrom, said end portions having outer edges away from said center piece, and end portion flaps integral with said outer edges for extending freely outward therefrom and inwardly and upwardly foldable from said end portions, each end portion flap being of a width to span said respective slots, whereby said cover may be interlocked with said box such that the cuff portions associated with said two oppositely directed side walls are disposed between corresponding side portion flaps and end portion flaps wherein said end portion flaps span said respective slots.

17. A cover according to claim 16, further comprising:

edge flaps integral with said side portions for extending freely outward therefrom and inwardly and upwardly foldable from said side portions for tucking beneath corresponding cuff portions of the box when said cover is interlocked with said box.

18. A cover according to claim 17, wherein said edge flaps are further foldable adjacent their outer ends.

19. A cover according to claim 16, wherein said end portion flaps are further foldable adjacent their outer ends.

* * * * *